United States Patent [19]

Runyon

[11] 4,285,609

[45] Aug. 25, 1981

[54] HINGE JOINT ASSEMBLY

[76] Inventor: John F. Runyon, 91 Kent St., Apt. 4, St. Paul, Minn. 55102

[21] Appl. No.: 131,622

[22] Filed: Mar. 19, 1980

[51] Int. Cl.[3] ..... F16B 7/00

[52] U.S. Cl. ..... 403/172; 403/220; 46/29

[58] Field of Search ..... 403/223, 220, 171, 172; 16/150; 46/29; 35/34, 18 A; 434/278, 277, 216

[56] References Cited

U.S. PATENT DOCUMENTS

| | | | |
|---|---|---|---|
| 2,432,960 | 3/1969 | Bombaci | 46/29 |
| 3,148,539 | 9/1964 | Cook . | |
| 4,074,477 | 2/1978 | Runyon . | |
| 4,111,574 | 9/1978 | Runyon . | |
| 4,145,850 | 3/1979 | Runyon . | |

FOREIGN PATENT DOCUMENTS

| | | | |
|---|---|---|---|
| 1292413 | 3/1962 | France | 46/29 |
| 41316 | of 1965 | German Democratic Rep. | 35/34 |
| 0100041 | 1/1968 | United Kingdom | 403/171 |

*Primary Examiner*—Andrew V. Kundrat

*Attorney, Agent, or Firm*—Burd, Bartz & Gutenkauf

[57] ABSTRACT

A hinge joint assembly for flexibly connecting rigid elongated structural components in the construction of modular buildings. More specifically, the joint permits the fastening of struts (rods, tubes, or the like) about a central hub. Each joint assembly includes a plurality of lengths of resilient tubing supported in slot openings in a body member. The flattened portion of the tubing in each slot functions as a hinge for relative movement of the adjacent unflattened portions. The unflattened open end portions of the tubing function as sockets to receive one end of a structural component. Several forms of joint assembly are shown and described.

10 Claims, 13 Drawing Figures

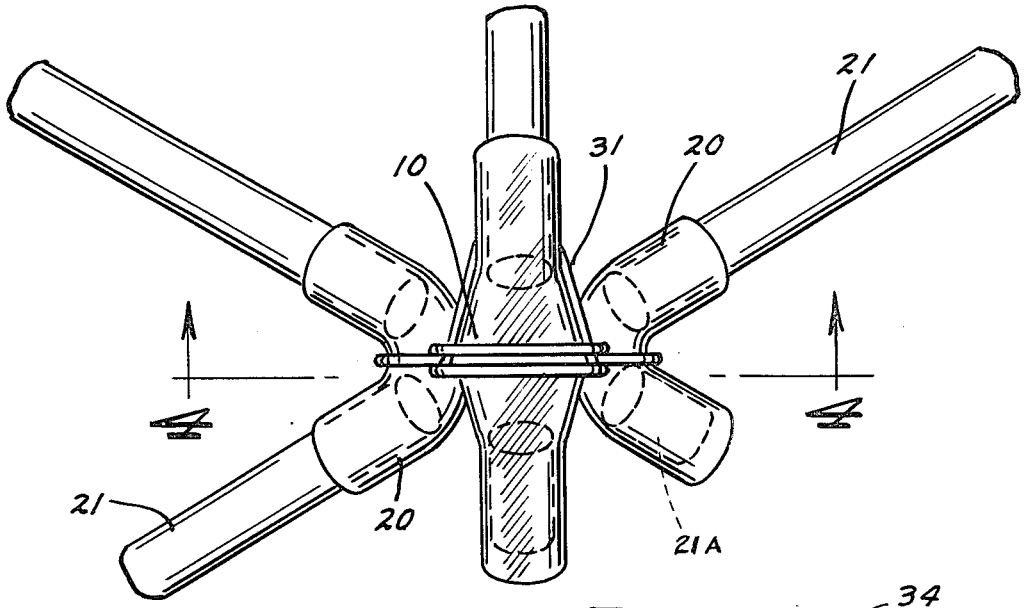
FIG. 1
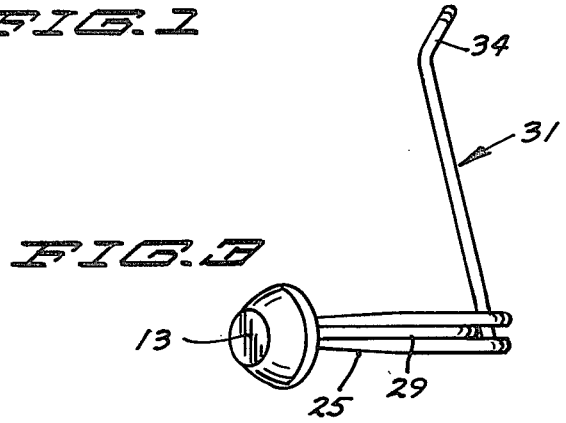
FIG. 3
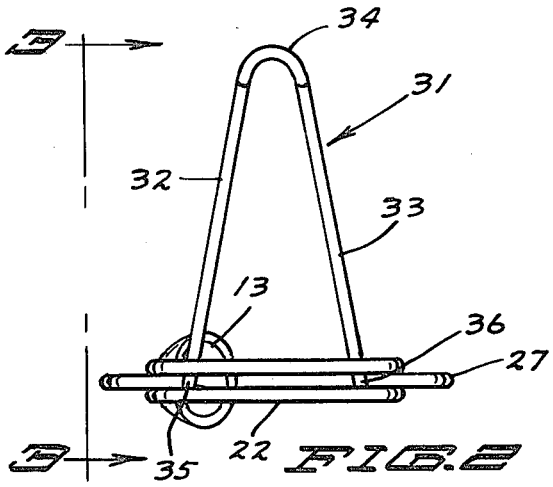
FIG. 2
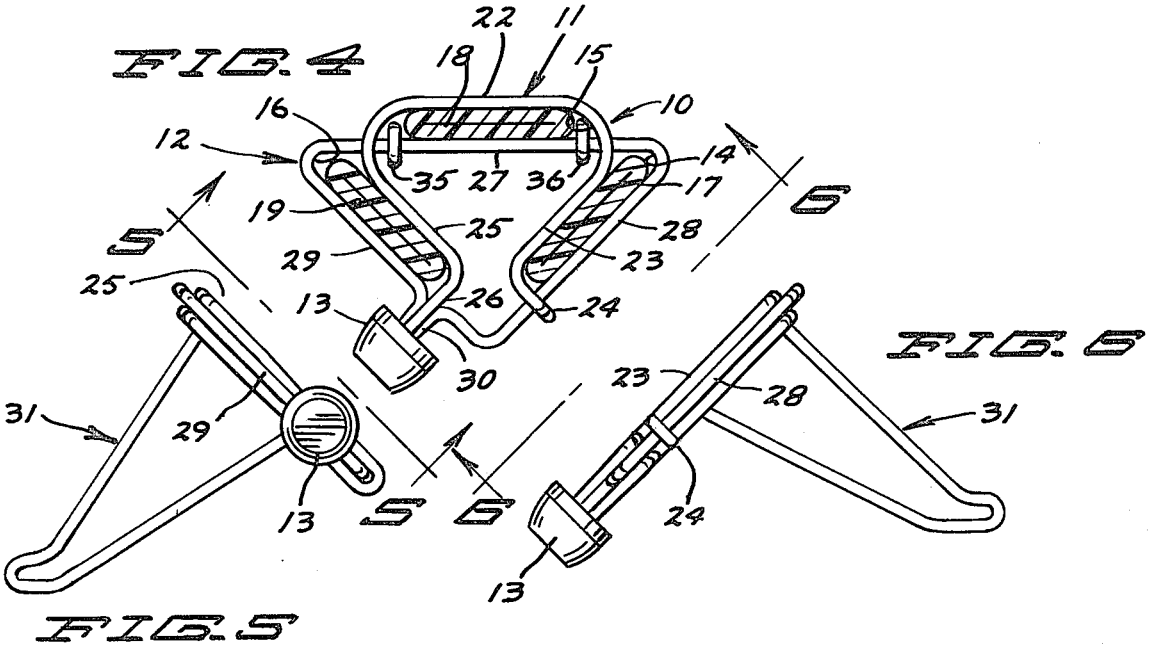
FIG. 4
FIG. 6
FIG. 5

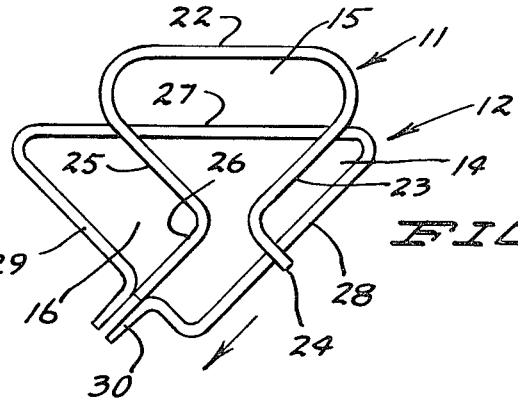
FIG. 7
FIG. 8
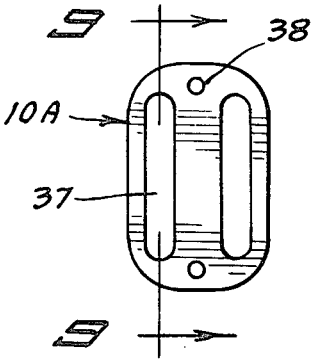
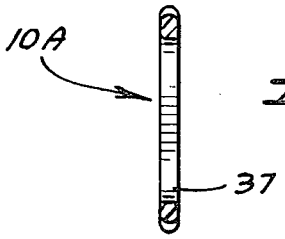
FIG. 9
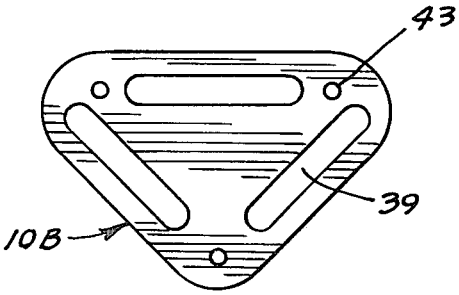
FIG. 10
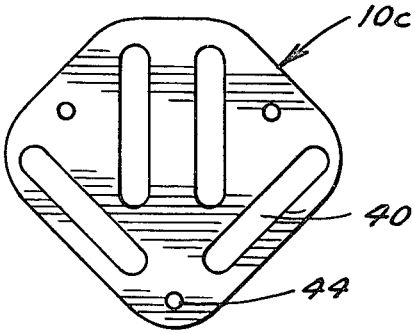
FIG. 11
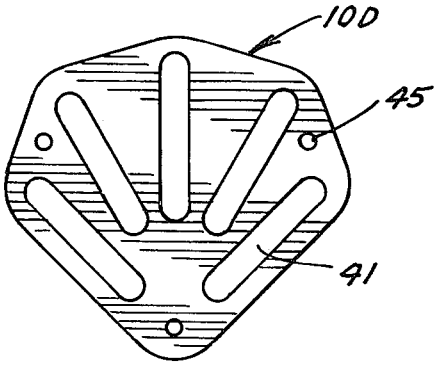
FIG. 12
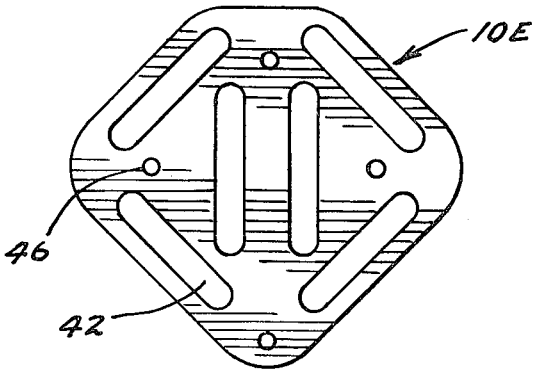
FIG. 13

HINGE JOINT ASSEMBLY

FIELD OF THE INVENTION

BACKGROUND OF THE INVENTION

This invention relates to a hinge joint assembly for flexibly connecting rigid structural components in the construction of modular buildings, such as those shown and described in my prior U.S. Pat. Nos. 4,074,477 and 4,145,850. Those building structures are formed from repeating alternating mirror-image forms of basic mathematically determinate structural modules. The structural modules are foldable. The joint assembly of the present invention permits the fastening of structural components such as struts (rods, tubes, or the like) about a central hinge body or hub.

THE PRIOR ART

Cook U.S. Pat. No. 3,148,539 discloses an ideal spherical hinge for the construction of an analytical frame structure for the study of the behavior of the structure under applied loads and the effective pressures on the structural members. However, the Cook invention is related to relatively small lightweight models as opposed to full-scale architectural structures, such as those of applicant. The Cook hinges are composed of tubular rubber or plastic sockets or plugs radiating from and molded integrally with a central hub and flexing of the structure is the result of flexing of the resilient hinge elements.

Applicant's prior U.S. Pat. No. 4,111,574 discloses a joint assembly formed of rigid non-resilient material. The joint assembly includes a plurality of flexibly interacting fastening units mounted for rotation about a common hinge pin. Flexing of the joint is the result of relative pivotal movement between the rigid non-resilient components of the joint assembly.

SUMMARY OF THE INVENTION

The present invention is directed to a hinge joint assembly for flexibly connecting a plurality of at least three elongated rigid structural components in the construction of modular buildings, such as those of the aforesaid U.S. Pat. Nos. 4,074,477 and 4,145,850. The hinge joint assembly comprises a body member or hub having a plurality of at least two slot openings, with at least two of the slot openings engaging a flattened portion of a corresponding number of lengths of resilient tubing. The unflattened portions of each of said lengths of tubing extending outwardly from the body member function as sockets to receive one end of an elongated structural component. The flattened portion of the tubing engaging each slot in the body functions as a hinge for relative movement of the adjacent unflattened portions and the structural components engaged by them. The hinge body may include from two to six or more slot openings, at least two of which are adjacent to a peripheral edge of the body member. The hinge body member may be constructed as a flat metal or rigid synthetic resinous material having slots cut or formed therein. Alternatively, as described, the hinge body member may be assembled from formed wire components.

BRIEF DESCRIPTION OF THE DRAWINGS

The invention is illustrated in the accompanying drawings in which corresponding parts are identified by the same numerals and in which:

FIG. 1 is a plan view of an assembled hinge joint according to one form of the present invention capable of connecting up to six struts comprising part of a building frame, and shown as accepting four struts and two retainer plugs;

FIG. 2 is a corresponding view of the hinge body;

FIG. 3 is a side elevation of the hinge body on the line 3—3 of FIG. 2 and in the direction of the arrows;

FIG. 4 is a fragmentary section on the line 4—4 of FIG. 1 and in the direction of the arrows;

FIG. 5 is a side view of the hinge body generally along the line 5—5 of FIG. 4 and shown without tubing for clarity;

FIG. 6 is an opposite side view of the hinge body generally along the line 6—6 of FIG. 4 and shown without tubing for clarity;

FIG. 7 is a pre-assembly view of the hinge body showing the position of the components prior to insertion of tubing;

FIG. 8 is a plan view of an alternative form of hinge body having two slot openings adapted to receive two lengths of tubing;

FIG. 9 is a sectional view on the line 9—9 of FIG. 8 and in the direction of the arrows;

FIG. 10 is a plan view of an alternative form of hinge body having three slot openings;

FIG. 11 is a plan view of an alternative form of hinge body having four slot openings;

FIG. 12 is a plan view of an alternative form of hinge body having five slot openings; and FIG. 13 is a plan view of an alternative form of hinge body having six slot openings.

DETAILED DESCRIPTION OF THE PREFERRED EMBODIMENT

Referring now to the drawings, and particularly to FIGS. 1–7, there is shown a preferred form of hinge joint assembly and its component parts. A hinge body or hub, indicated generally at 10, is composed of a first component 11 and a second component 12 in engagement with each other and secured together by means of a locking element 13. As best seen in FIG. 4, the body components 11 and 12 are assembled in such a manner as to define three slot openings 14–16. Short lengths of resilient tubing 17–19 are flattened and engage the openings 14–16, respectively. The unflattened end portions 20 of the tubing 17–19 which extend from the slot openings in the hinge body function as sockets and each is adapted to receive an elongated structural component 21 in the form of a rigid strut, such as a rod or tube, or a short cylindrical retainer plug 21A.

The first hinge body component 11 is formed from stiff heavy wire in a generally triangular configuration. This component has a pair of parallel base elements 22 spaced apart by approximately one wire diameter. Integral with the base elements 22, a pair of parallel spaced apart side elements 23 extend downwardly (FIG. 4) and inwardly side-by-side from one end of the pair of base elements. A loop 24 connects the pair of side elements, that loop extending downwardly and outwardly from the side elements 23. A pair of parallel spaced apart further side elements 25 are integral with the base elements 22 and extend inwardly and downwardly from the opposite ends thereof toward loop 24. A pair of short parallel spaced apart fastening elements 26 extend downwardly and outwardly from the free ends of the further side elements 25. The parallel elements composing the first hinge body component 11 are spaced apart by approximately the thickness of the second hinge body component 12 which likewise is formed from stiff heavy wire in a generally triangular configuration and which is embraced in the assembled joint between the spaced apart elements of the first component 11.

The second hinge body component 12 is composed of a base element 27, a side element 28 integral therewith and extending downwardly and inwardly from one end of the base element, and a further side element 29 extending downwardly and inwardly from the opposite end of the base element. A break in side elements 29 is made by two short parallel side-by-side fastening elements 30 which extend downwardly and outwardly from the side element 29 intermediate of its ends.

The overall triangular area of hinge body component 12 is somewhat greater than the corresponding area of component 11. When the components are assembled with component 12 embraced between the dual parallel spaced apart elements of component 11, slot opening 15 is defined between the base elements 22 and 27. Slot opening 14 is defined between the first side elements 23 and 28. Slot opening 16 is defined between the further side elements 25 and 29.

As seen in FIG. 7, the hinge body components 11 and 12 are initially assembled by inserting component 12 so as to lie between the dual elements of component 11 with side element 28 engaging the inside surface of loop 24. A length of resilient tubing is inserted into slot opening 14. That length of tubing is then compressed by relative movement of component 12 (downwardly and to the left in the Figure) to enlarge slot openings 15 and 16 sufficiently to easily receive two additional lengths of resilient tubing. Then the components are returned to the position of FIG. 4 and secured together by means of a locking element 13 engaging the ends of the fastening elements 26 and 30 of the body components.

Locking element 13 may be press-fit over the ends of the fastening elements 26 and 30. Preferably, however, threads are swaged into those fastening elements and the locking element is screwed thereon.

Once the hinge joint is assembled, struts 21 or retainer plugs 21A are readily inserted into the sockets 20 formed in the free ends of tubing 17–19. Where only one unflattened end portion of a length of resilient tubing receives a strut, the other end receives a retainer plug 21A, preferably cut from the same material as the struts, so that the tubing cannot be pulled out of the hinge body slot. Preferably the inside diameter of the sockets is slightly less than the outside diameter of the struts such that they fit with a tight fit and, in most cases, the use of adhesive is not required.

The tubing is formed from natural or synthetic rubber or synthetic resinous materials, such as polyvinyl chloride, having high strength and long flex life. The struts are preferably formed from strong lightweight material such as aluminum tubing.

Preferably, in order to provide additional rigidity in the assembled joint, a strut stabilizer 31 is secured to the hinge body. The stabilizer 31 is in the form of an open elongated loop of generally isosceles triangular configuration having converging side elements 32 and 33 adapted to engage one of the struts or lengths of tubing which extends beyond the hinge body. An arcuate connection 34 between the ends of side elements 32 and 33 is displaced slightly from the plane of the side elements toward the tubing and strut to be engaged by the tubing. The opposite ends of the side elements 32 and 33 are provided with loops 35 and 36, respectively, which hook over base element 27 of hinge body component 12 to pivotally secure the stabilizer to the stabilizer loops 35 and 36 hold base element 27, and thus slot opening 15, perpendicular to the strut or tubing engaged by stabilizer loop connection 34, as shown in FIG. 1. Preferably the length of stabilizer 31 is greater than the length of tubing which extends beyond the hinge body. Loop connection 34 then engages a strut and is secured thereto by means of wire or the like.

Reference to elements extending "downwardly", "outwardly", etc. has reference solely to the orientation of the components as shown in FIGS. 4 and 7, and is for purposes of clarity and understanding only. In use, the components are not restricted to any particular spatial orientation.

Referring now to FIGS. 8 through 13, there are shown several different embodiments of alternative forms of hinge bodies or hubs for use in conjunction with flexible tubing for assembling hinge joints. Referring to FIGS. 8 and 9, the hinge body 10A is in the form of a generally flat plate having a pair of slot openings 37 therein to receive two short lengths of flattened resilient tubing, each slot receiving one length of tubing. Body 10A may be cast or molded from metal, synthetic resinous plastic, ceramic, or the like, or stamped from metal or synthetic resinous sheet material, or the like. The surfaces of the slot openings are preferably rounded and smoothed, as shown, to facilitate insertion of the tubing and minimize injury thereto. Preferably holes 38 are provided to receive cables or other devices hung at the building hub joint. Such holes may also receive attachments to maintain hub orientation so that unbalanced strut thrusts will not twist hub joints causing increased eccentricities.

FIGS. 10 through 13 show other forms of hinge or hub bodies 10B through 10E having slot openings 39–42 and holes 43–46, respectively. These hubs are adapted to receive three to six lengths of tubing to form more complex hinge joints. For example, the four, five and six slotted hubs may be used to assemble three-dimensional trusses, the four slot hub may be used to form an octahedral truss, etc. The positions of the slots are chosen so that the strut ends nest close together with the longitudinal axes of the struts meeting with minimal eccentricity at the hub. The top ends of the hubs, oriented as in FIGS. 8–13, face the outer surface of the modular building when the strut framework encloses space. These top edges are designed so as to protrude minimally above the strut ends covered by flexible tubing so that fabric or other similar covering material is not punctured by the hubs.

It is apparent that many modifications and variations of this invention as hereinbefore set forth may be made without departing from the spirit and scope thereof. The specific embodiments described are given by way of example only and the invention is limited only by the terms of the appended claims.

The embodiments of the invention in which an exclusive property or privilege is claimed are defined as follows:

1. A hinge joint assembly according to claim 1 wherein:

(A) the joint assembly includes three lengths of resilient tubing, (B) said body member has three slot openings, (C) said body member includes:

(1) a generally triangular first component having (a) a pair of parallel spaced apart base elements, (b) a pair of parallel spaced apart side elements integral with said base elements and extending downwardly and inwardly from one end thereof, (c) a loop integral with said side elements connecting the ends thereof, said loop extending downwardly and outwardly from the side elements, (d) a pair of parallel spaced apart further side elements integral with said base elements and extending inwardly and downwardly from the opposite end thereof and toward said loop, (e) a pair of short parallel spaced apart fastening elements integral with said further side elements and extending downwardly and outwardly from the further side elements, (2) a generally triangular second component embraced between the spaced apart elements of said first component and having (a) a base element spaced inwardly from the base elements of the first component to define a slot therewith, (b) a side element integral with said second component base element and spaced outwardly from the side elements of the first component to define a slot therewith, said side element engaging the inside of the loop connecting the side elements of the first component, (c) a further side element integral with said second component base element and spaced outwardly from the further side elements of the first component to define a slot therewith, (d) a pair of short parallel side-by-side fastening elements integral with and dividing said further side element and extending downwardly and outwardly from the further side element and engaging the fastening elements of the first component, and (3) a locking element engaging the fastening elements of the components to secure the components together.

2. A hinge joint assembly according to claim 1 wherein said body member components are formed from stiff heavy wire.

3. A hinge joint assembly according to claim 1 wherein said component fastening elements have swaged threads in their outer surfaces and said locking element is internally threaded.

4. A hinge joint assembly according to claim 1 wherein a strut stabilizer is secured to said body member, said stabilizer comprising:

(A) an open loop having converging side elements adapted to embrace and engage one of said lengths of tubing, (B) an arcuate connection between the ends of said side elements displaced slightly from the plane of the side elements, and (C) means at the opposite ends of said side elements pivotally securing the stabilizer to the base element of said second body component.

5. A hinge joint assembly for flexibly connecting a plurality of at least three elongated structural components in the construction of modular buildings, said hinge joint assembly comprising:

(A) a plurality of at least two lengths of resilient tubing, (B) a body member having a plurality of at least two slot openings, (1) at least two of the slot openings (a) being adjacent to a peripheral edge of the body member and (b) engaging a flattened portion of one of said lengths of tubing, (2) the flattened portion of the tubing in each slot functioning as a hinge for relative movement of the adjacent unflattened portions, and (3) the unflattened portion of said tubing spaced from the body member functioning as a socket to receive one end of an elongated structural component.

6. A hinge joint assembly according to claim 5 wherein said body member comprises a generally flat plate having the slot openings formed therein.

7. A hinge joint assembly according to claim 6 wherein said body member is generally rectangular and has a pair of parallel spaced apart slot openings.

8. A hinge joint assembly according to claim 6 wherein said body member is generally triangular and has three slot openings, each extending along and adjacent to a peripheral edge of the body member.

9. A hinge joint assembly according to claim 6 wherein said body member has from four to six slot openings, at least two of which extend along and are adjacent to a peripheral edge of the body member.

10. A hinge joint assembly according to claim 6 wherein said slot openings have smooth rounded surfaces.

* * * * *

UNITED STATES PATENT AND TRADEMARK OFFICE

CERTIFICATE OF CORRECTION

PATENT NO. : 4,285,609

DATED : August 25, 1981

INVENTOR(S) : John F. Runyon

It is certified that error appears in the above-identified patent and that said Letters Patent are hereby corrected as shown below:

On the title page, under FOREIGN PATENT DOCUMENTS, British Patent "0100041" should be --1100041--.

Column 4, line 66, claim numbered "1" should be claim --2--.

Column 5, line 48, claim numbered "2" should be claim --3--, and should depend on claim --2--.

Column 5, line 51, claim numbered "3" should be claim --4--, and should depend on claim --2--.

Column 6, line 3, claim numbered "4" should be claim --5--, and should depend on claim --2--.

Column 6, line 15, claim numbered "5" should be claim --1--, it being the only independent claim in the patent.

Column 6, line 35, claim 6 should depend on claim --1-- instead of claim "5".

Signed and Sealed this

*Seventeenth* Day of *November 1981*

[SEAL]

*Attest:*

GERALD J. MOSSINGHOFF

*Attesting Officer*

*Commissioner of Patents and Trademarks*